US005884709A

United States Patent [19]

Evans et al.

[11] Patent Number: 5,884,709

[45] Date of Patent: Mar. 23, 1999

[54] ABOVE-GROUND FLAMMABLE FLUID CONTAINMENT APPARATUS AND METHOD OF CONTAINING SAME

[76] Inventors: Michael Stephen Evans, 10909 Bronson Rd., Clermont, Fla. 34711; William L. Stamp, 130 Loma Bonita Dr., Davenport, Fla. 33837

[21] Appl. No.: 829,675

[22] Filed: Mar. 31, 1997

[51] Int. Cl.[6] ..... A62C 2/00

[52] U.S. Cl. ..... 169/46; 169/68; 220/88.1; 220/565; 220/567.2; 222/108

[58] Field of Search ..... 169/16, 45–49, 169/51, 66–68; 220/88.1, 560.3, 567.2, 913, 918, 921; 239/120, 121, 208, 209, 550; 222/108

[56] References Cited

U.S. PATENT DOCUMENTS

| | | | |
|---|---|---|---|
| 965,761 | 7/1910 | Spawn | 169/68 |
| 1,754,005 | 4/1930 | Witter | 169/66 |
| 2,584,650 | 2/1952 | Woodruff | 239/121 X |
| 2,706,527 | 4/1955 | Guljas et al. | 169/68 X |
| 4,023,621 | 5/1977 | Olson | 169/68 |
| 4,374,478 | 2/1983 | Secord et al. | 220/567.2 X |
| 4,664,199 | 5/1987 | Grant et al. | 169/68 X |
| 4,960,222 | 10/1990 | Fields, III | 220/567.2 X |
| 5,092,024 | 3/1992 | McGarvey | 220/88.1 X |
| 5,282,546 | 2/1994 | Bauer | 220/567.2 X |
| 5,314,027 | 5/1994 | Wood | 169/68 X |
| 5,405,087 | 4/1995 | Waryu et al. | 239/121 X |
| 5,450,978 | 9/1995 | Crisp et al. | 220/565 |
| 5,564,588 | 10/1996 | Reese | 220/565 |
| 5,573,068 | 11/1996 | Sharma et al. | 169/68 |
| 5,695,089 | 12/1997 | Reese et al. | 220/567.2 X |

*Primary Examiner*—Andres Kashnikow
*Assistant Examiner*—Steven J. Ganey

[57] ABSTRACT

An above-ground flammable fluid containment apparatus and method are provided. The apparatus preferably has a primary fluid container for positioning flammable fluid therein and a secondary container having a bottom and a plurality of walls connected to and extending upwardly from the bottom so as to define an inner chamber. The plurality of walls include front and rear walls and a plurality of side walls connected to and extending between the front and rear walls. The secondary container has at least portions of the primary fluid container positioned within the inner chamber so that outer surfaces of the primary fluid container and inner surfaces of the secondary container define an interstitial space. A a weather shielding cover overlies and connects to upper end portions of the primary fluid container and the secondary container for enclosing the primary fluid container and for shielding the primary fluid container from exposure to various environmental conditions. The weather shielding cover is preferably mounted to the secondary container so that air can readily flow through respective front and rear openings of the apparatus into the interstitial space surrounding the primary container to thereby cool the primary container. The front and rear openings are respectively defined by upper end peripheries of the front and rear walls of the secondary container and lower end peripheries of the weather shielding cover.

37 Claims, 6 Drawing Sheets

12
13
14
20
24
30
32
34
37
40
41
42
44
46
47
49
60
62
65
67
70

16
17
18
20
21
22
23
24
25
26
27
28
30
31
32
37
38
39
43
P
70

ABOVE-GROUND FLAMMABLE FLUID CONTAINMENT APPARATUS AND METHOD OF CONTAINING SAME

FIELD OF THE INVENTION

The present invention relates to the field of fluid containment systems and, more particularly, to above-ground containment of flammable fluids.

BACKGROUND OF THE INVENTION

The storage or containment of volatile or toxic fluids has been a safety and environmental concern for numerous years. Underground storage tanks or systems have been used in various industries, e.g., fuel distribution, in attempts to stabilize tanks and reduce potential damage to tanks from external sources. These underground storage tanks, however, have increasingly been criticized for actual and potential environmental problems such as leakage of fluid from the tanks into the ground. Also, the owners of these underground storage tanks have problems in determining whether and when a tank has been damaged. These tanks can additionally be expensive to install and maintain and generally lack mobility.

Above-ground storage tanks have also been developed over the years, but due to the environmental and other problems associated with underground storage tanks these above-ground storage tanks have been increasingly emphasized. As shown in U.S. Pat. No. 5,282,546 by Bauer titled "Composite Above Ground Liquid Storage Vault" and U.S. Pat. No. 5,564,588 by Reese titled "Method And Storage Tank System For Aboveground Storage Of Flammable Liquids," these above-ground storage tanks or systems often include a primary tank or fluid container having at least portions thereof positioned within a secondary tank or fluid container to thereby allow the second container to inhibit leakage of the fluid from the primary container directly into the ground or surrounding surface mounting area. The space between the outer surfaces of the primary tank and the inner surfaces of the secondary tank is often partially or entirely filled with other granular insulating material to provide a protective layer to the primary tank. In other types of related tank systems, the secondary tank can be formed of a concrete material which forms the protective layer. The protective layer, for example, can inhibit damage to the primary tank, can inhibit the initiating of or spreading of a fire associated with the primary tank, and can provide a temperature insulating layer to the primary tank.

As shown in U.S. Pat. No. 5,450,978 by Crisp et al. titled "Environment Compatible Storage Vessel," sand and other non-conductive particulate medium have also been used instead of concrete for the insulating layer and as the sole support for the primary tank when positioned within the secondary tank. Despite the advancements made in the above-ground storage tanks over the years, these tank systems continue to be heavy, not readily portable, and lack effective mobility particularly when the primary tank is encased with concrete. Also, these tank systems can still be expensive to construct and maintain, time consuming to install, shifting and sliding on the sand when transporting or after installation, and ineffective in providing structural support to the primary tank.

Additionally, some applications of these above-ground tank systems do not require a concrete insulating layer. As shown in U.S. Pat. No. 5,197,627 by Disabato et al. titled "Double Walled Storage Tank," the tank systems used for these applications often lack a secondary tank or container and simply use a double-walled structure. Other tanks systems, such as shown in U.S. Pat. No. 5,555,999 by Wilcox titled "Secondary Containment For Aboveground Flammable And Combustible Liquid Storage Tanks" and U.S. Pat. No. 5,346,093 by De Benedittis et al. titled "Liquid Storage System," often partially expose upper portions of the fuel tank to various weather conditions. These at least partially exposed tank systems, however, can create problems associated with harsh weather or environmental conditions, e.g., heat, rain, snow, and can also be ineffective in providing structural support to the primary tank.

SUMMARY OF THE INVENTION

With the foregoing in mind, the present invention advantageously provides an above-ground flammable fluid containment apparatus and method which inhibits exposure and damage of a primary tank of the apparatus, and fluid positioned therein, from various environmental conditions. The present invention also advantageously provides an above-ground flammable fluid containment apparatus and method which is readily mobile for installing or moving an above-ground storage tank. The present invention additionally provides an above-ground flammable fluid containment apparatus and method which is simple in construction, relatively light weight and portable, and keeps fluid positioned therein cool in high temperature environmental conditions. The present invention further provides a stable above-ground flammable fluid containment apparatus that is relatively light weight and yet protectively inhibits the explosiveness or flammability of fluid positioned within the apparatus.

More particularly, an above-ground flammable fluid containment apparatus is provided which includes a primary fluid container for positioning flammable fluid therein and a secondary container having a bottom and a plurality of walls connected to and extending upwardly from the bottom so as to define an inner chamber. The plurality of walls include front and rear walls and a plurality of side walls connected to and extending between the front and rear walls. The secondary container has at least portions of the primary fluid container positioned within the inner chamber so that outer surfaces of the primary fluid container and inner surfaces of the secondary container define an interstitial space. A weather shielding cover overlies and connects to upper end portions of the primary container and the secondary container for enclosing the primary container and for shielding the primary container from exposure to various environmental conditions. The weather shielding cover is preferably mounted to the secondary container so that air can readily flow through respective front and rear openings of the apparatus into the interstitial space surrounding the primary container to thereby cool the primary container. The front and rear openings are respectively defined by upper end peripheries of the front and rear walls of the secondary container and lower end peripheries of the weather shielding cover.

According to another aspect of an above-ground flammable fluid containment apparatus of the present invention, and so as to provide an air flow path and further define the front and rear openings, the weather shielding cover of the present invention preferably includes a top panel connected to upper end portions of the primary container and front and rear cover panels connected to and extending downwardly from the top panel so that lower end peripheries of the front and rear cover panels extend downwardly beyond and spaced-apart from upper end peripheries of the respective front and rear walls of the secondary container. Upper end portions of the primary container preferably extend upwardly at a higher elevation than upper end portions of the side walls of the secondary container. The weather shielding cover detachably connects to and has portions thereof extending upwardly at a predetermined angle from the upper end portions of the side walls of the secondary container toward the upper end portions of the primary container and overlies the upper end portions of the primary container so that moisture, such as associated with rain, snow, ice, and dew, and other items such as leaves, brush, and rocks, advantageously readily flow downwardly from the weather shielding cover.

According to still another aspect of an above-ground flammable fluid containment apparatus of the present invention, upper end portions of the primary container preferably are connected to the weather shielding cover. The primary container preferably includes lifting means secured to upper portions of the primary container and extending through the shielding cover for readily lifting the combination of the primary container and the shielding cover into and out of the inner chamber of the secondary container. The lifting means for lifting the combination, for example, advantageously allows the inner surfaces of the walls and the inner chamber of the secondary container to be emptied, cleaned, re-painted, repaired, or accessed for repairs. It also advantageously can increase the mobility of the apparatus by allowing the secondary container to be readily moved to another desired location and can simplify the original transporting and set-up of the apparatus at a customer site.

According to yet another aspect of an above-ground flammable fluid containment apparatus of the present invention, a fluid irrigating system can be connected to the weather shielding cover for providing fluid irrigation to the primary and secondary containers. The irrigation system preferably includes main system piping connected to the shielding cover and positioned so as to underlie the shielding cover for distributing fluid therethrough. A plurality of fluid distribution nozzles are preferably connected to the main system piping for distributing fluid outwardly and downwardly from the main system piping toward the primary and secondary containers. A connection port preferably extends from the main system piping through the shielding cover for connecting auxiliary piping to the main system piping.

According to a further aspect of an above-ground flammable fluid containment apparatus of the present invention, a fluid distribution nozzle containment housing is connected to an outer surface of the secondary container for housing a fluid distribution nozzle therein. The fluid distribution nozzle containment housing includes a fluid distribution nozzle drip container positioned therein and arranged to receive a fluid distribution nozzle for collecting excess fluid dripping from the fluid distribution nozzle. The fluid distribution nozzle drip container preferably has a plurality of walls connected along a common line thereof and connected to the inner surface of the containment housing so as to define an inner drip container chamber. At least one of the walls of the drip container has a side opening extending therethrough to the inner drip container chamber for positioning a distal end of a fluid distribution nozzle through the side opening. Lower portions of the drip container have an inclined surface, such as converging walls, and a lower end opening positioned at lower ends of the inclined surface so that excess fluid dripping from a distal end of a fluid distribution nozzle readily flows to and through the lower end opening for collection therethrough.

According to second and third embodiments of the present invention, an above-ground flammable fluid containment apparatus is provided which includes a primary fluid container for positioning flammable fluid therein and a secondary container having a bottom and a plurality of walls connected to and extending upwardly from the bottom so as to define an inner chamber. The plurality of walls include front and rear walls and side walls connected to and extending between the front and rear walls. The secondary container preferably has at least portions of the primary fluid container positioned within the inner chamber. Aggregate material, e.g., preferably sand or small pebbles or rocks, is positioned within the inner chamber and surrounds the primary container, e.g., forming at least a six-inch buffer zone. A plurality of insulated mounting support brackets are preferably connected to lower end portions of the primary container for positioning in lower end portions of the inner chamber of the secondary container to thereby support the primary container when mounted in the inner chamber and insulate the primary container from the secondary container. A plurality of insulated support straps are preferably connected to upper end portions of the primary container and are preferably connected to the plurality of side walls of the secondary container for additionally supporting the primary container so as to insulate the primary container from the secondary container. A weather shielding cover overlies and connects to upper end portions of the primary container and the secondary container for enclosing the primary container and for shielding the primary container from exposure to various environmental conditions.

The present invention further includes a method of flammable fluid containment. The method preferably includes positioning at least portions of a primary fluid container within an inner chamber of a secondary container so that outer surfaces of the primary fluid container and inner surfaces of the secondary container define an interstitial space and positioning a weather shielding cover so as to overlie upper end portions of the primary container and the secondary container to thereby enclose the primary container and shield the primary container from exposure to various environmental conditions. The method also includes mounting the weather shielding cover to the secondary container so as to provide an air flow path through respective front and rear openings into the interstitial space surrounding the primary container to thereby cool the primary container. The front and rear openings are respectively defined by upper end peripheries of the front and rear walls of the secondary container and lower end peripheries of the weather shielding cover.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

Figure 1:
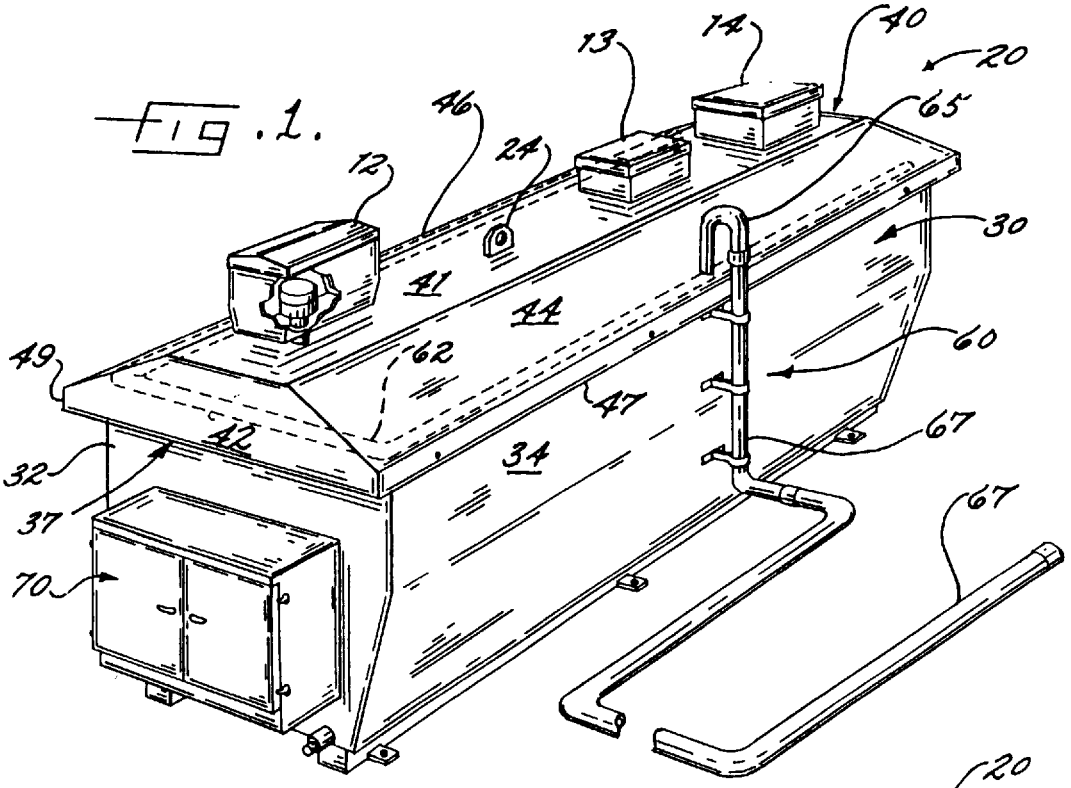
FIG. 1 is a perspective view of an above-ground flammable fluid containment apparatus according to a first embodiment of the present invention.
Figure 2:
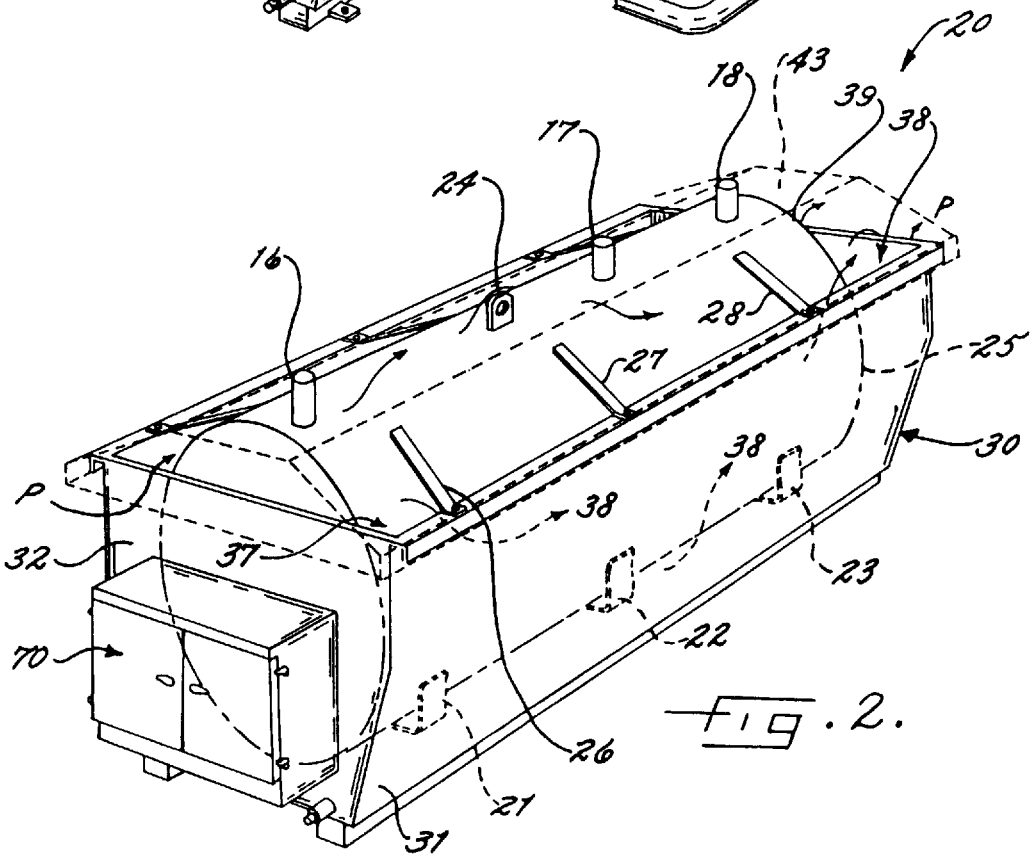
FIG. 2 is a perspective view of an above-ground flammable fluid containment apparatus illustrating a primary tank and a shielding cover thereof in phantom lines according to a first embodiment of the present invention.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation are used to indicate similar elements in alternative embodiments.

FIGS. 1–3 and 5 illustrate an above-ground flammable fluid containment apparatus 20 according to a first embodiment of the present invention. The above-ground flammable fluid containment apparatus 20 preferably has a primary fluid container 25 for positioning flammable fluid therein and a secondary container 30 having a bottom 31 and a plurality of walls 32, 33, 34, 36 connected to and extending upwardly from the bottom so as to define an inner chamber 35. The primary fluid container 25, e.g., a tank, preferably has a cylindrical shape and, as understood by those skilled in the art, preferably includes a plurality of openings 16, 17, 18 formed therein for filling, distributing, measuring, relieving pressure from, evaluating, or accessing the contents of the container 25. These openings 16, 17, 18 preferably connect to and extend through the secondary container 30, and include respective confinement containers or boxes 12, 13, 14 confining and overlying the openings, e.g., pipes or valves. It will be understood by those skilled in the art, however, that various shapes and sizes of the primary container 25, including rectangular or polygonal shapes, can be used as well according to the present invention. The primary fluid container 25 as illustrated preferably is used for various petroleum based fuels, but it will be understood by those skilled in the art that other flammable fluids such as various fuel or chemical compounds in liquid and/or gaseous form can be used as well according to the present invention.

The plurality of walls of the secondary container 30 preferably include front and rear walls 32, 33 and a plurality of side walls 34, 36 connected to and extending between the front and rear walls 32, 33. The secondary container 30 has at least portions of the primary fluid container 25 positioned within the inner chamber 35 so that outer surfaces of the primary fluid container 25 and inner surfaces of the secondary container 30 define an interstitial space 38. Although the side walls 34, 36 of the secondary container 30 are preferably structured and shaped as illustrated, it will be understood by those skilled in the art that the side walls 34, 36 can be formed of one or more flat panels or also be formed of arcuately-shaped panels.

Figure 3:
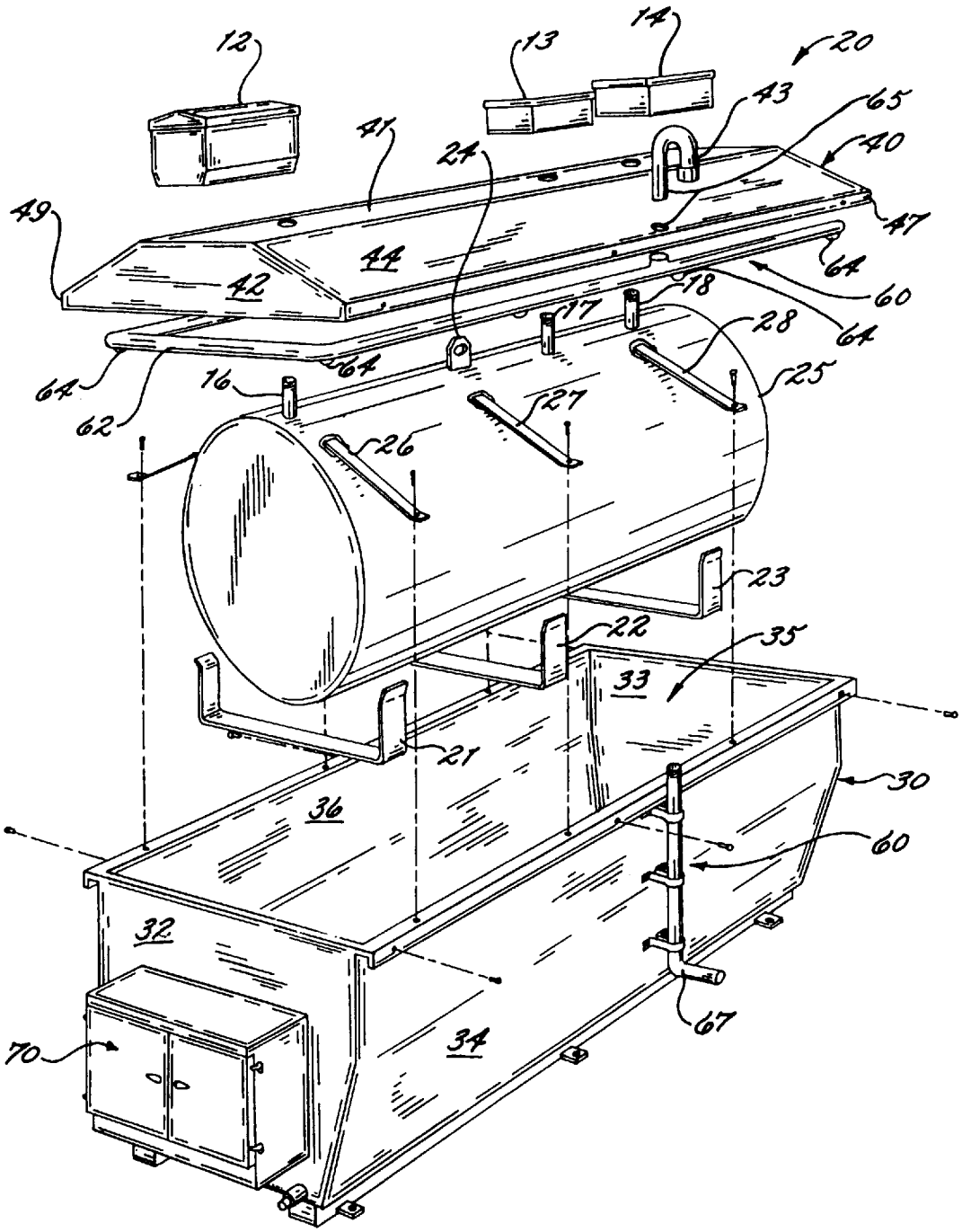
FIG. 3 is an exploded perspective view of an above-ground flammable fluid containment apparatus according to a first embodiment of the present invention.

As best illustrated in FIGS. 1 and 3, a weather shielding cover 40 according to the present invention preferably overlies and connects to upper end portions of the primary container 25 and the secondary container 30 for enclosing the primary container 25 and for shielding the primary container 25 from exposure to various environmental conditions. The weather shielding cover 40 is preferably mounted to the secondary container 30 so that air can readily flow through respective front and rear openings 37, 39 of the apparatus 20 into the interstitial space 38 surrounding the primary container 25 to thereby cool the primary container 25. The front and rear openings 37, 39 are respectively defined by upper end peripheries of the front and rear walls 32, 33 of the secondary container 30 and lower end peripheries of the weather shielding cover 40.

So as to provide an air flow path P and further define the front and rear openings 37, 39, the weather shielding cover 40 of the present invention preferably includes a top panel 41 connected to upper end portions of the primary container 25 and extends generally parallel to the bottom 31 of the secondary container 30. Front and rear cover panels 42, 43 are connected to and extending downwardly from the top panel 41 so that lower end peripheries of the front and rear cover panels 42, 43 extend downwardly beyond and spaced-apart from upper end peripheries of the respective front and rear walls 42, 43 of the secondary container 30. The above-ground flammable fluid containment apparatus 20 as illustrated and described advantageously is simple in construction, readily portable, and keeps fluid positioned within the primary container 25 of the apparatus 20 cool, particularly in high temperature environmental conditions.

Figure 5:
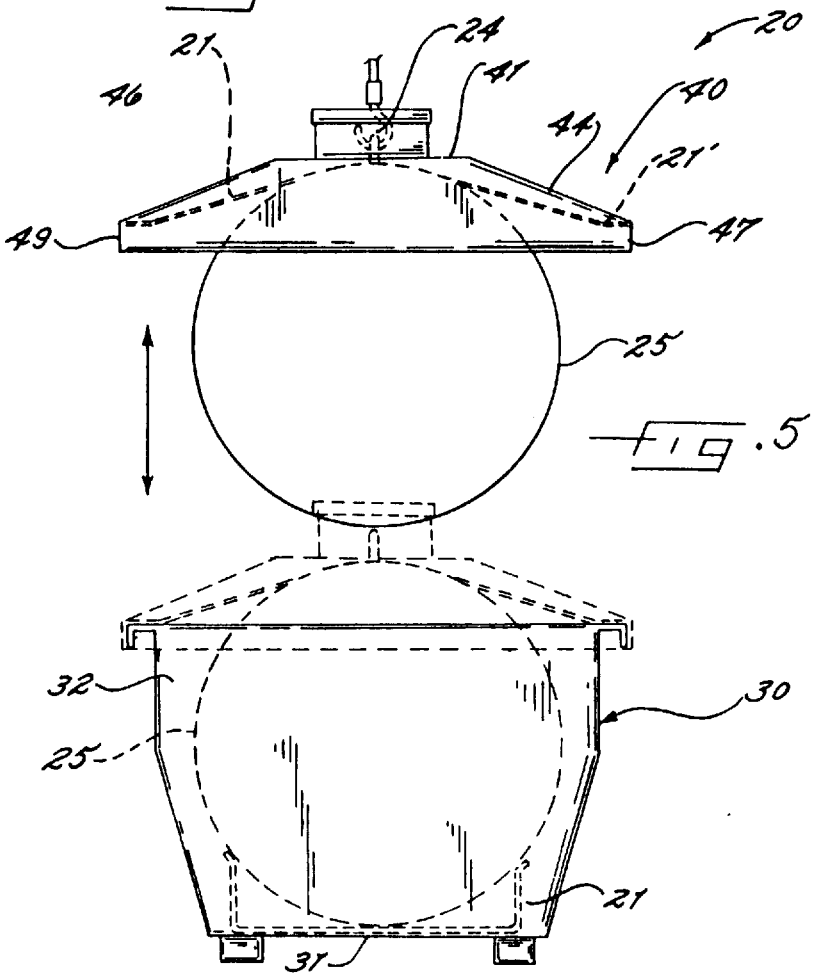
FIG. 5 is an exploded front elevational view of an above-ground flammable fluid containment apparatus according to a first embodiment of the present invention.

Also, upper end portions of the primary container 25 of the apparatus 20 preferably extend upwardly at a higher elevation than upper end portions of the side walls 34, 36 of the secondary container 30 (see, e.g., FIGS. 3 and 5). The weather shielding cover 40 detachably connects to and has portions thereof extending upwardly at a predetermined angle from the upper end portions of the side walls 34, 36 of the secondary container 30 toward the upper end portions of the primary container 25 and overlies the upper end portions of the primary container 25 so that moisture, such as associated with rain, snow, ice, and dew, as well as other items, such as leaves, brush, or rocks, advantageously readily flow downwardly from the weather shielding cover 40.

The weather shielding cover 40 further includes a plurality of side panels 44, 46, 47, 49. The plurality of sides panels include a first pair of side panels 44, 46 connected to and extending divergingly downward from the top panel 41 at a predetermined angle, e.g., between 10–35 degress from the horizontal plane, and a second pair of side panels 47, 49 each connected to a respective one of the first pair of side panels 44, 46 and extending downwardly generally parallel to the plurality of side walls 34, 36 of the secondary container 30. The second pair of side panels 47, 49 are preferably detachably connected to upper peripheries of the side walls 34, 36 by threaded fasteners or bolts. The upper peripheries of the secondary container 30 generally form a lip or ledge to which the cover 40 is detachably connected. By use of this mounting configuration and the weather shielding cover 40, the above-ground flammable fluid containment apparatus 20 of the present invention thereby inhibits exposure and damage to the primary container 25 of the apparatus 20, and fluid positioned therein, from various environmental conditions.

The apparatus 20 further has a plurality of mounting support brackets 21, 22, 23 connected to lower end portions of the primary container 25 for positioning in lower end portions of the inner chamber 35 of the secondary container 30. The brackets 21, 22, 23 preferably abuttingly contact or connect to the bottom 31 of the secondary container 30 to thereby support the primary container 25 when mounted in the inner chamber 35. A plurality of elongate support straps 26, 27, 28 are preferably connected to upper portions of the primary container 25, e.g., welded to the primary container, and are detachably connected to upper portions of the secondary container 30 for providing additional support for the primary container 25 when positioned within the inner chamber 35. The support straps 26, 27, 28 are also preferably detachably connected to upper peripheries of the side walls 34, 36 by threaded fasteners or bolts (see FIG. 3).

As best illustrated in FIG. 5, upper end portions of the primary container 25 preferably are connected to the weather shielding cover 40. The connection between the upper end portions of the primary container 25 is preferably along the top panel 41 of the weather shielding cover 40. The primary container 25 preferably includes lifting means secured to upper portions of the primary container 25 and extending through an opening formed in the shielding cover 40 for readily lifting the combination of the primary container 25 and the shielding cover 40 into and out of the inner chamber 35 of the secondary container 30. The lifting means is preferably provided by a hook member 24 having respective ends thereof secured to the upper end of the primary fluid container 25. The hook member 24 extends through the top panel 41 of the weather shielding cover 40 so that a boom, a winch, or other lifting system, e.g., attached to a truck or tractor, can readily access and lift the combination. The lifting means, for example, advantageously allows the inner surfaces of the walls 31, 32, 34, 36 of and the inner chamber 35 of the secondary container 30 to be emptied, cleaned, re-painted, repaired, or accessed for repairs. It also advantageously can increase the mobility of the apparatus 20 by allowing the secondary container 30 to be readily moved to another desired location and can simplify the original transporting and set-up of the apparatus 20 at a customer site.

As best illustrated in FIGS. 1 and 3, the above-ground flammable fluid containment apparatus 20 of the present invention also advantageously has a fluid irrigating system 60 connected to the weather shielding cover 40 for providing fluid irrigation to the primary and secondary containers 25, 30. The fluid is preferably water or fire extinguishing chemicals in liquid or gaseous form which advantageously can extinguish a potential fire and/or cool the containers 25, 30 if needed. The irrigation system 60 preferably includes main system piping 62, e.g., metal tubes or pipes, connected to the shielding cover 40 and positioned so as to underlie the shielding cover 40 for distributing fluid therethrough. A plurality of fluid distribution nozzles 64 are preferably connected to the main system piping 62 for distributing fluid outwardly and downwardly from the main system piping 62 toward the primary and secondary containers 25, 30. A connection port 65 preferably extends from the main system piping 62 through the shielding cover 40 for connecting auxiliary piping 67 to the main system piping 62.

A first portion of the auxiliary piping 67 is preferably detachably connected with fasteners to one of the side walls 34 of the secondary container 30. A second portion of the auxiliary piping 67 is preferably detachably connected to the first portion thereof and extends outwardly from the secondary container 30 to a range of about 25–50 feet therefrom. This extension of the second portion of the auxiliary piping 67 advantageously allows a hose or other piping to readily connect to the auxiliary piping 67 at fairly far distance for supplying the fluid to the system 60 in the event of a fire associated with or around the containers 25, 30 so that the connection inhibits damage to those in the area in the event of an explosion, or the spreading of smoke or fire.

Figure 4:
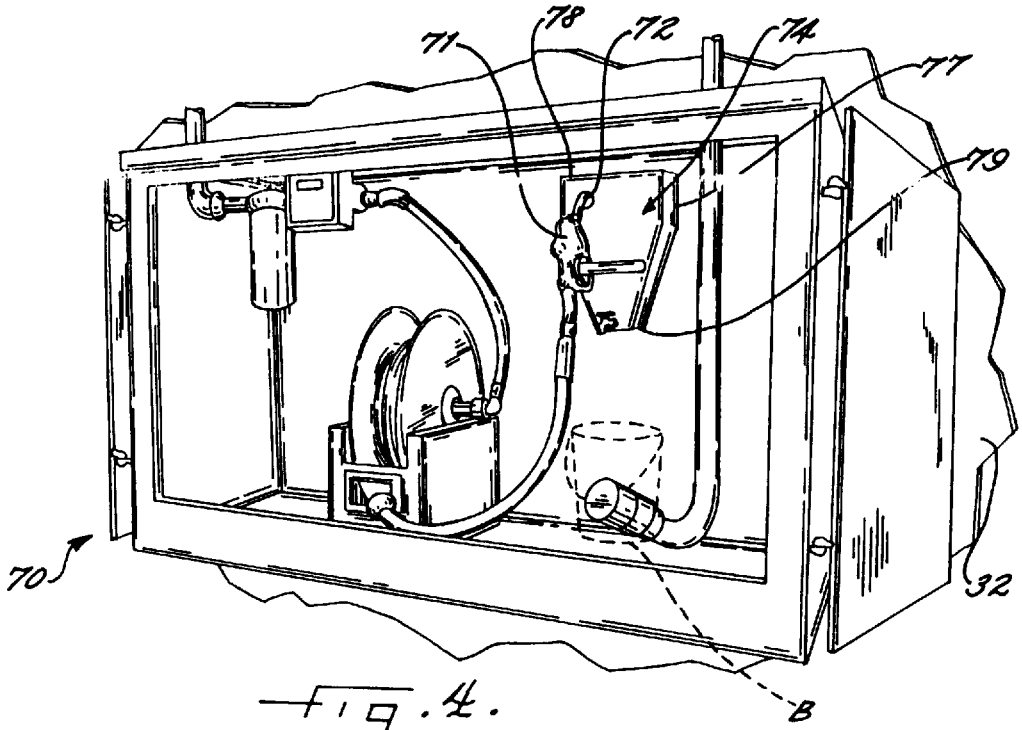
FIG. 4 is a perspective view of a drip container for a fluid distribution nozzle of an above-ground flammable fluid containment apparatus according to the present invention.

As best illustrated in FIGS. 1 and 4, the above-ground flammable fluid containment apparatus 20 of the present invention further preferably has a fluid distribution nozzle containment housing 70 connected to an outer surface of the secondary container 30 for housing a fluid distribution nozzle 71, as well as associated hosing and connector piping, therein. The fluid distribution nozzle 71 is preferably positioned in fluid communication with the primary container 25 an operates or is actuated as readily understood by those skilled in the art, including by the use of the handle as illustrated in FIG. 4. The fluid distribution nozzle containment housing 70 includes a fluid distribution nozzle drip container 74 positioned therein arranged to receive the fluid distribution nozzle 71 for collecting excess fluid dripping from the fluid distribution nozzle 71.

The fluid distribution nozzle drip container 74 preferably has a plurality of walls connected along a common line thereof and connected to the inner surface of the containment housing 70 so as to define an inner drip container chamber 76. At least one of the walls of the drip container 74 has a side opening 78 extending therethrough to the inner drip container chamber 76 for positioning a distal end of a fluid distribution nozzle 71 through the side opening. Lower portions of the drip container 74 preferably have an inclined inner surface, such as provided by converging walls, and a lower end opening 79 positioned at lower ends of the inclined surface, e.g., the converging walls, so that excess fluid dripping from a distal end of a fluid distribution nozzle 71 readily flows to and through the lower end opening 79 for collection therethrough. The lower end opening 79, for example, can form a drain for the drip container 74 and can include a plug, valve, grating, or other device for either continuously or periodically releasing excess fluid therefrom, e.g., such as into a bucket or other container.

As illustrated in FIGS. 6–10, an above-ground flammable fluid containment apparatus 20', 20" according to second and third embodiments of the present invention are also provided. Because many of the features and elements of the second and third embodiments of the apparatus 20', 20" are similar, for brevity and conciseness, the second and third embodiments are described herein together with further description added to features and elements which deviate between the embodiments.

Accordingly, an apparatus 20', 20" according to the second and third embodiments preferably includes a primary fluid container 25', 25" for positioning flammable fluid therein and a secondary container 30', 30" having a bottom 31', 31" and a plurality of walls connected to and extending upwardly from the bottom so as to define an inner chamber 35', 35". The plurality of walls include front and rear walls 32', 32", 33', 33" and a plurality of side walls 34', 34", 36', 36" connected to and extending between the front and rear walls 32', 32", 33', 33". The secondary container 30', 30" preferably has at least portions of the primary fluid container 25', 25", and preferably the entire primary container in these embodiments, positioned within the inner chamber 35', 35".

Figure 10:
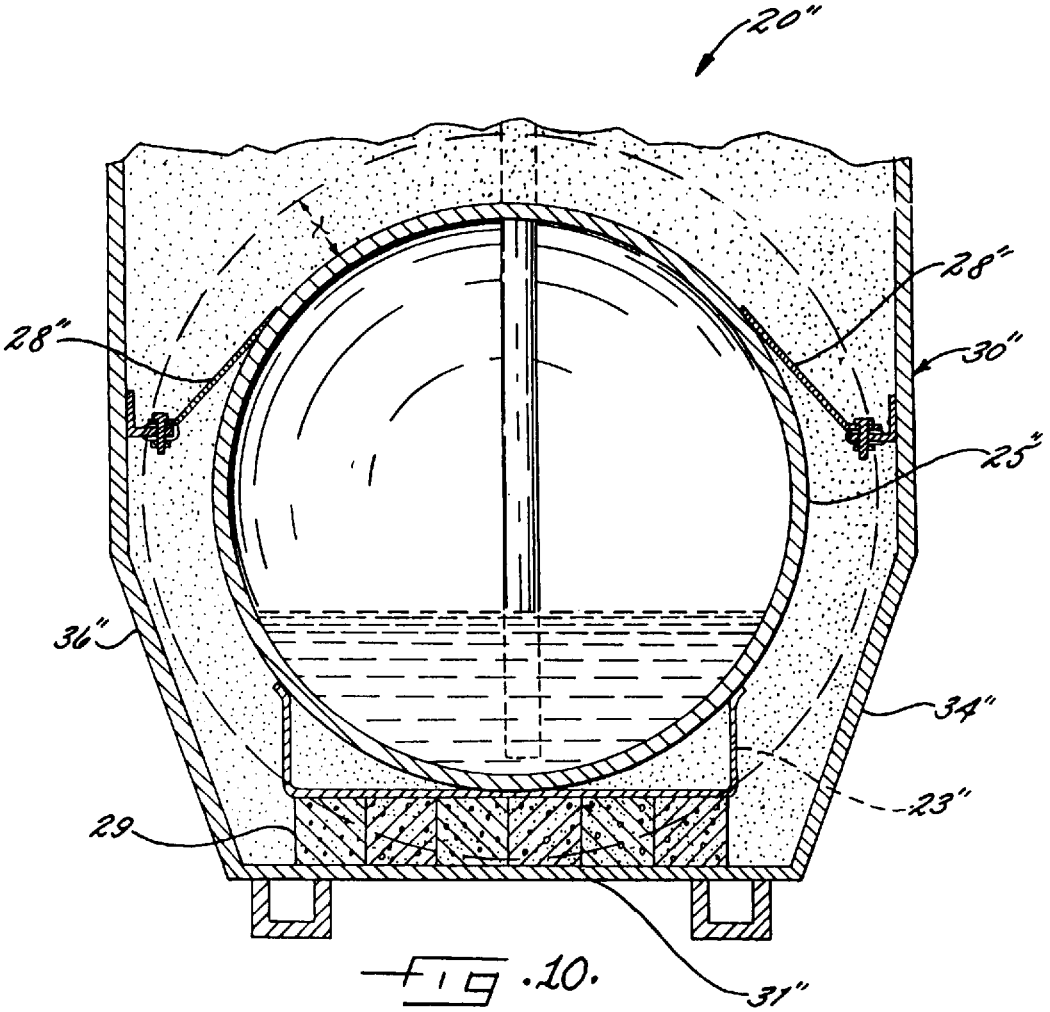
FIG. 10 is a vertical sectional view of an above-ground flammable fluid containment apparatus taken along line 10—10 of FIG. 9 according to a third embodiment of the present invention.

Advantageously, aggregate material S, e.g., preferably sand or small pebbles or rocks, is positioned within the inner chamber 35', 35" and surrounds the primary container 25', 25" to preferably provide at least a six-inch buffer zone around the primary container (see, e.g., FIG. 10). Pipe extension members or nipples connect to and extend upwardly from the openings 16', 16", 17', 17", 18', 18" of the primary container 25', 25" so as to extend through the aggregate materials to the cover 40', 40". A plurality of insulated mounting support brackets 21', 21", 22', 22", 23', 23" are preferably connected to lower end portions of the primary container 25', 25" for positioning in lower end portions of the inner chamber 35', 35" of the secondary container 30', 30" to thereby support the primary container 25', 25" when mounted in the inner chamber 35', 35" and insulate the primary container 25', 25" from the secondary container 30', 30" (see also FIG. 10). The insulated mounting support brackets 21', 21", 22', 22", 23', 23", for example, can advantageously be formed by positioning a plurality of bricks 29 so as to underlie metal support brackets 21, 22, 23 similar to those illustrated in the first embodiment. The bricks allow ready setup and transporting of the system yet provide at least a six-inch buffer between the outer surface of the primary container and the bottom of the secondary container. It will be understood by those skilled in the art, however, that concrete, ceramic, or other insulating material and configurations for the insulated support brackets 21', 21", 22', 22", 23', 23", as well as other insulating configurations, can be used as well according to the present invention. The insulated support brackets 21', 21", 22', 22", 23', 23", however, should be structure to advantageously receive a substantial amount of the weight or support for the primary container 25', 25" so that the sand material provides no or little support or only supplements the support brackets in supporting the primary container.

Figure 7:
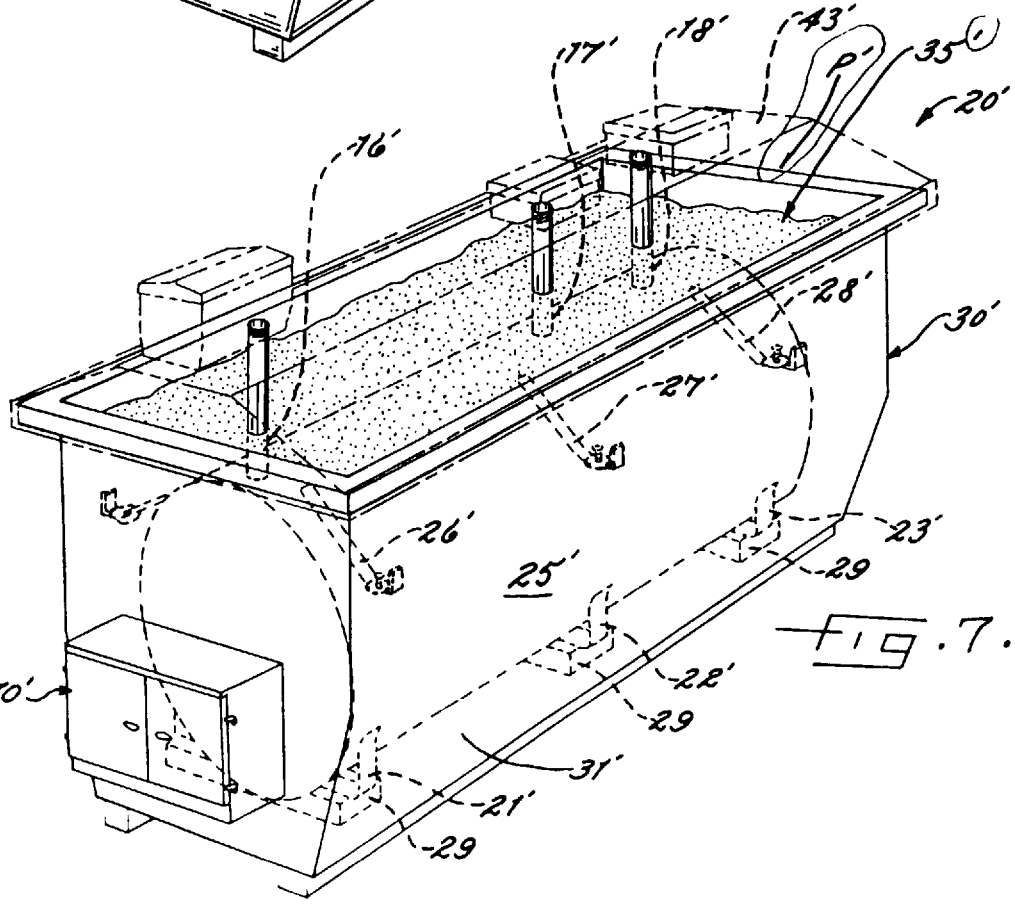
FIG. 7 is a perspective view of an above-ground flammable fluid containment apparatus illustrating a primary tank and shielding cover thereof in phantom lines according to a second embodiment of the present invention.
Figure 8:
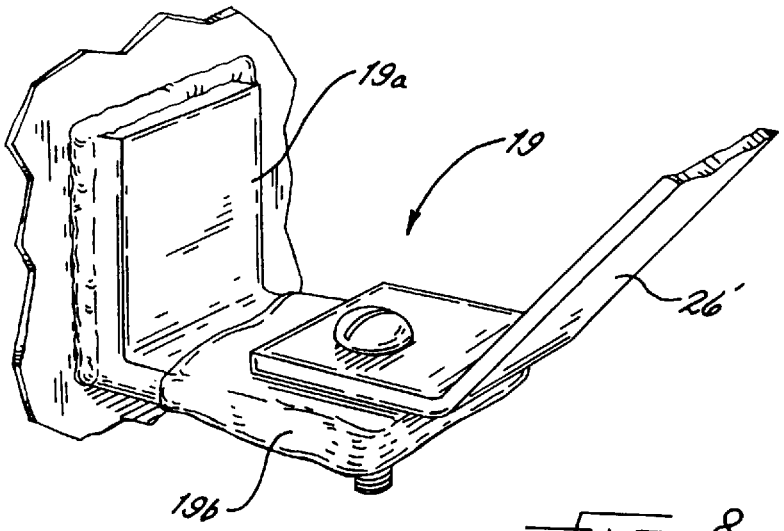
FIG. 8 is a fragmentary perspective view of an insulated supporting strap connector of an above-ground flammable fluid containment apparatus according to second and third embodiments of the present invention.
Figure 9:
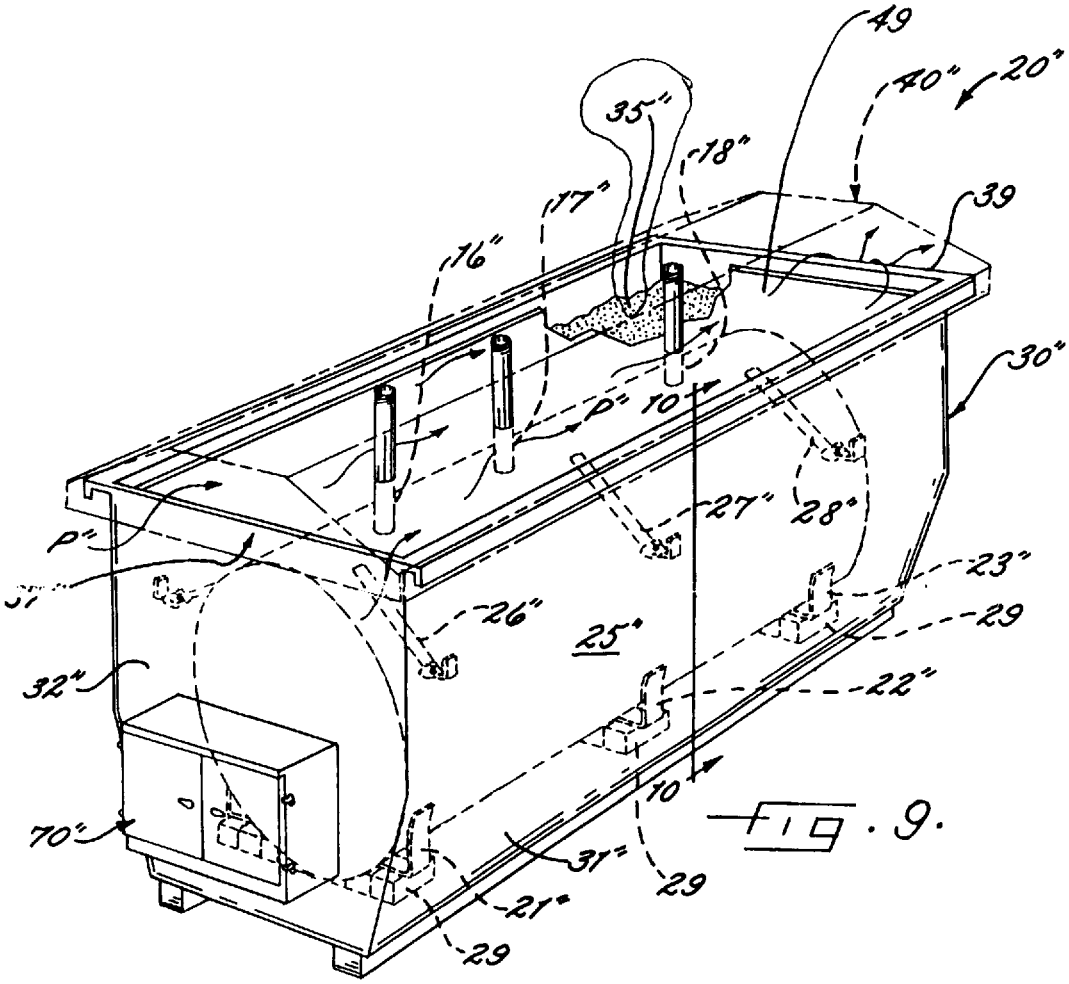
FIG. 9 is a perspective view of an above-ground flammable fluid containment apparatus illustrating a primary tank and shielding cover thereof in phantom lines according to a third embodiment of the present invention.

A plurality of insulated support straps 26', 26", 27', 27", 28', 28", as best illustrated in FIGS. 7, 8, and 9, are preferably connected to upper end portions of the primary container 25', 25" and are connected to the plurality of side walls 34', 34", 36', 36" of the secondary container 30', 30" for additionally supporting the primary container 25', 25" so as to insulate the primary container from the secondary container. The insulated support straps 26', 26", 27', 27", 28', 28", for example, can be provided by an insulated supporting strap connector 19 as illustrated in FIG. 8. The connector 19, for example, has portions 19*a* thereof connected to e.g., welded, to the side walls of the secondary container and other insulated portions 19*b*, e.g., formed of ceramic, tile, concrete, or other insulated material, for connecting the straps thereto. As understood by those skilled in the art, the insulation material is preferably a ceramic material, e.g., tile, a concrete material or other insulating material. The support straps and the support brackets together advantageously secure and stabilize the primary container 25', 25" within the inner chamber 35', 35" of the secondary container 30', 30" so that the primary container does not shift, slide, or rotate within the secondary container.

A weather shielding cover 40', 40" overlies and connects to upper end portions of the primary container 25', 25" and the secondary container 30', 30" for enclosing the primary container and for shielding the primary container from exposure to various environmental conditions. In the third embodiment of the apparatus 20", however, the weather shielding cover 40" does not include front and rear openings (see FIG. 9). Instead, an air flow path is not provided, and lower peripheries of the front and rear panels 42", 43" of the cover 40" connect to the upper peripheries of the front and rear walls 32", 33" of the secondary container 30". In other words, the secondary container 30" and the cover 40" completely enclose the sand material S and the primary container 25" to thereby prevent or inhibit the sand material S from being discharged from the secondary container 30" such as when damaged by an external source.

Figure 6:
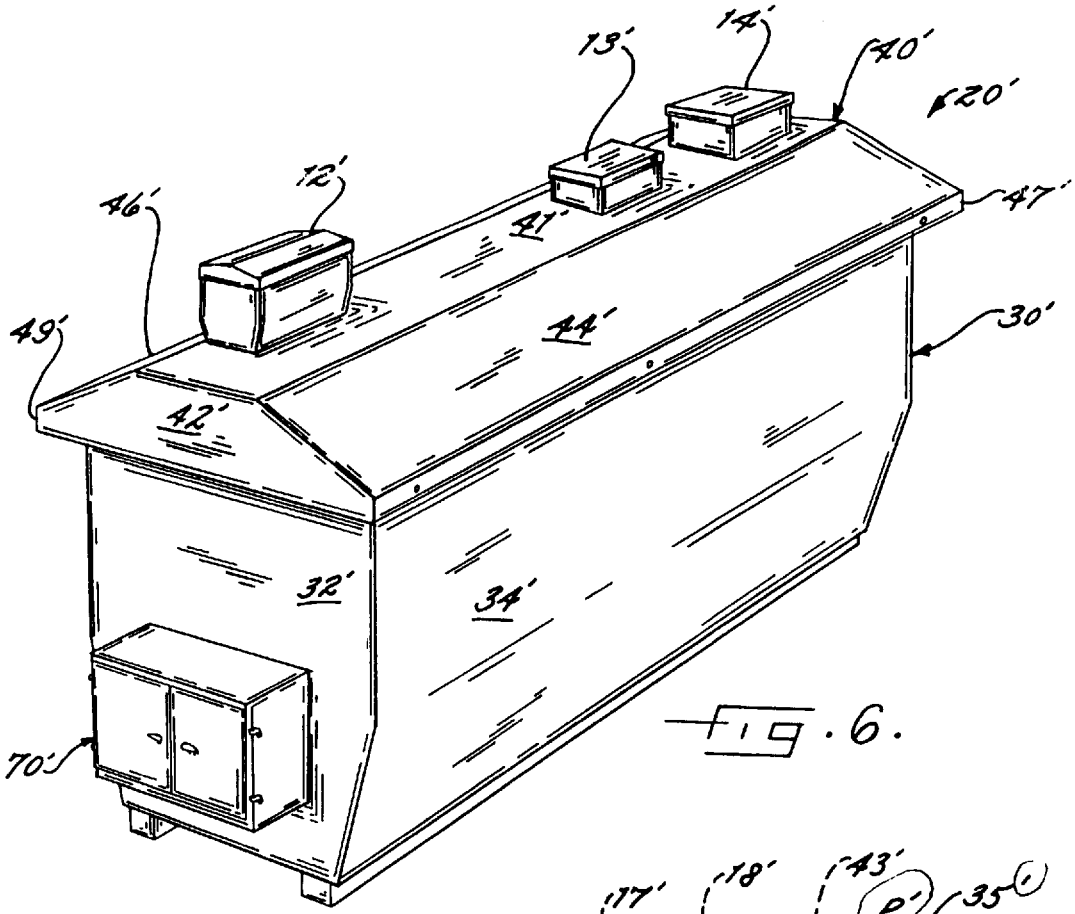
FIG. 6 is a perspective view of an above-ground flammable fluid containment apparatus according to a second embodiment of the present invention.

In contrast, as best illustrated in FIGS. 6–7, the apparatus 20' according to the second embodiment preferably includes an air flow path P' and preferably includes an inner confinement cover 49, overlying the primary container 25', underlying the weather shielding cover 40', and connected to the secondary container 30' for confining the aggregate material, e.g., sand material S, to the secondary container 30'. In this second embodiment, the weather shielding cover 40' is preferably mounted to the secondary container 30' so that air can readily flow through respective front and rear openings 37', 39' of the apparatus 20' to thereby provide additional cooling to the primary container 25'. The front and rear openings 37', 39'0 are respectively defined by upper end peripheries of the front and rear walls 32', 33' of the secondary container 30' and lower end peripheries of the weather shielding cover 40'.

Upper end portions of the primary container 25' preferably extend upwardly at a higher elevation than upper end portions of the side walls 34', 36' of the secondary container 30'. The weather shielding cover 40' also preferably detachably connects to and has portions thereof extending upwardly at a predetermined angle from the upper end portions of the side walls 34', 36' of the secondary container 30' toward the upper end portions of the primary container 25' and overlies the upper end portions of the primary container 25' so that moisture readily flows downwardly from the weather shielding cover 40'.

FIGS. 1–10 also advantageously illustrate methods of flammable fluid containment according to the present invention. The method preferably includes positioning at least portions of a primary fluid container 25 within an inner chamber 35 of a secondary container 30 so that outer surfaces of the primary fluid container 25 and inner surfaces of the secondary container 30 define an interstitial space 38 and positioning a weather shielding cover 40 so as to overlie upper end portions of the primary container 25 and the secondary container 30 to thereby enclose the primary container 25 and shield the primary container 25 from exposure to various environmental conditions. The method also includes mounting the weather shielding cover 40 to the secondary container 30 so as to provide an air flow path P through respective front and rear openings 37, 39 into the interstitial space 38 surrounding the primary container 25 to thereby cool the primary container 25 and fluid positioned therein. The front and rear openings 37, 39 are respectively defined by upper end peripheries of the front and rear walls 32, 33 of the secondary container 30 and lower end peripheries of the weather shielding cover 40.

The method can additionally include connecting a plurality of support straps 26, 27, 28 connected to upper portions of the primary container 25 to upper portions of the secondary container 30 for providing additional support to the primary container 25 when positioned in the inner chamber 35 of the secondary container 30. These straps 26, 27, 28 can also be disconnected from the upper portions of the secondary container 30 and the combination of the primary container 25 and the shielding cover 40 lifted into and out of the inner chamber 35 of the secondary container 30.

The method can further include the weather shielding cover 40 having a top panel 41 connected to upper end portions of the primary container 25 and front and rear cover panels 42, 43 connected to and extending downwardly from the top panel 41 so that lower end peripheries of the front and rear cover panels 42, 43 extend downwardly beyond and spaced-apart from upper end peripheries of the respective front and rear walls 42, 43 of the secondary container 30. The method can additionally include cooling the primary container 25 by air flowing through the front and rear openings 37, 39 and surrounding the primary container 25.

The method according to the present invention can further provide a fluid irrigating system 60 connected to the weather shielding cover 40 so as to allow fluid supplied to the fluid irrigation system to irrigate the primary and secondary containers 25, 30 and a fluid distribution nozzle containment housing 70 connected to an outer surface of the secondary container 30. The fluid distribution nozzle containment housing 70 preferably includes a fluid distribution nozzle drip container 74 positioned therein and arranged to receive a fluid distribution nozzle 71. The method can then further include positioning a fluid distribution nozzle 71 on the fluid distribution nozzle drip container 74 and collecting excess fluid dripping from the fluid distribution nozzle 71 positioned thereon.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An above-ground flammable fluid containment apparatus comprising:

a primary fluid container for positioning flammable fluid therein;

a secondary container having a bottom and a plurality of walls connected to and extending upwardly from the bottom so as to define an inner chamber, said plurality of walls including front and rear walls and side walls connected to and extending between the front and rear walls, said secondary container having at least portions of said primary fluid container positioned within the inner chamber so that outer surfaces of said primary fluid container and inner surfaces of said secondary container define an interstitial space; and a weather shielding cover overlying and connected to upper end portions of said primary container and said secondary container for enclosing said primary container and for shielding said primary container from exposure to various environmental conditions, said weather shielding cover being mounted to said secondary container so that air can readily flow through respective front and rear openings of the apparatus into the interstitial space surrounding said primary container to thereby cool said primary container, the front and rear openings being respectively defined by upper end peripheries of the front and rear walls of said secondary container and lower end peripheries of said weather shielding cover.

2. An apparatus as defined in claim 1, wherein upper end portions of said primary container extend upwardly at a higher elevation than upper end portions of the side walls of said secondary container, and wherein said weather shielding cover detachably connects to and has portions thereof extending upwardly at a predetermined angle from the upper end portions of the side walls of said secondary container toward the upper end portions of said primary container and overlies the upper end portions of said primary container so that moisture readily flows downwardly from said weather shielding cover.

3. An apparatus as defined in claim 2, wherein upper end portions of said primary container are connected to said weather shielding cover, and wherein said primary container includes lifting means secured to upper portions of said primary container and extending through said shielding cover for readily lifting the combination of said primary container and said shielding cover into and out of the inner chamber of said secondary container.

4. An apparatus as defined in claim 3, further comprising a plurality of support straps connected to upper portions of said primary container and detachably connected to upper portions of said secondary container for supporting said primary container.

5. An apparatus as defined 1, wherein said weather shielding cover includes a top panel connected to upper end portions of said primary container and front and rear cover panels connected to and extending downwardly from said top panel so that lower end peripheries of the front and rear cover panels extend downwardly beyond and spaced-apart from upper end peripheries of the respective front and rear walls of said secondary container.

6. An apparatus as defined in claim 5, wherein said weather shielding cover further includes a plurality of side panels, the plurality of sides panels include a first pair of side panels connected to and extending divergingly downward from said top panel at a predetermined angle and a second pair of side panels each connected to a respective one of said first pair of side panels and extending downwardly generally parallel to the plurality of side walls of said secondary container.

7. An apparatus as defined in claim 1, further comprising a fluid irrigating system connected to said weather shielding cover for providing fluid irrigation to said primary and secondary containers.

8. An apparatus as defined in claim 7, wherein said irrigation system includes main system piping connected to said shielding cover and positioned so as to underlie said shielding cover for distributing fluid therethrough, a plurality of fluid distribution nozzles connected to said main system piping for distributing fluid outwardly and downwardly from said main system piping toward said primary and secondary containers, and a connection port extending from said main system piping through said shielding cover for connecting auxiliary piping to said main system piping.

9. An apparatus as defined in claim 7, further comprising a fluid distribution nozzle containment housing connected to an outer surface of said secondary container and a fluid distribution nozzle positioned in said fluid distribution nozzle containment housing and in fluid communication with said primary fluid container, said fluid distribution nozzle containment housing including a fluid distribution nozzle drip container positioned therein and positioned to receive at least portions of said fluid distribution nozzle for collecting excess fluid dripping from said fluid distribution nozzle.

10. An apparatus as defined in claim 9, wherein said fluid distribution nozzle drip container comprises a plurality of walls connected along a common line thereof and connected to the inner surface of the containment housing so as to define an inner drip container chamber, at least one of the walls of said drip container having a side opening extending therethrough to the inner drip container chamber for positioning a distal end of said fluid distribution nozzle through the side opening, lower portions of said drip container having converging walls and a lower end opening positioned at lower ends of the converging walls so that excess fluid dripping from a distal end of said fluid distribution nozzle readily flows to and through the lower end opening.

11. An apparatus as defined in claim 1, wherein upper end portions of said primary container extend upwardly at a higher elevation than upper end portions of the side walls of said secondary container, and wherein said weather shielding cover detachably connects to and has portions thereof extending upwardly at a predetermined angle from the upper end portions of the side walls of said secondary container toward the upper end portions of said primary container and overlies the upper end portions of said primary container so that moisture readily flows downwardly from said weather shielding cover.

12. An apparatus as defined in claim 11, wherein upper end portions of said primary container are connected to said weather shielding cover, and wherein said primary container includes lifting means secured to upper portions of said primary container and extending through said shielding cover for readily lifting the combination of said primary container and said shielding cover into and out of the inner chamber of said secondary container.

13. An apparatus as defined in claim 12, further comprising a plurality of support straps connected to upper portions of said primary container and detachably connected to upper portions of said secondary container for supporting said primary container.

14. An apparatus as defined 13, wherein said weather shielding cover includes a top panel connected to upper end portions of said primary container and extending generally parallel to the bottom of said secondary container and front and rear cover panels connected to and extending downwardly from said top panel so that lower end peripheries of the front and rear cover panels extend downwardly beyond and spaced-apart from upper end peripheries of the respective front and rear walls of said secondary container.

15. An apparatus as defined in claim 14, wherein said weather shielding cover further includes a plurality of side panels, the plurality of sides panels include a first pair of side panels connected to and extending divergingly downward from said top panel at a predetermined angle and a second pair of side panels each connected to a respective one of said first pair of side panels and extending downwardly generally parallel to the plurality of side walls of said secondary container.

16. An apparatus as defined in claim 15, further comprising a fluid irrigating system connected to said weather shielding cover for providing fluid irrigation to said primary and secondary containers.

17. An apparatus as defined in claim 16, wherein said irrigation system includes main system piping connected to said shielding cover and positioned so as to underlie said shielding cover for distributing fluid therethrough, a plurality of fluid distribution nozzles connected to said main system piping for distributing fluid outwardly and downwardly from said main system piping toward said primary and secondary containers, and a connection port extending from said main system piping through said shielding cover for connecting auxiliary piping to said main system piping.

18. An above-ground flammable fluid containment apparatus comprising:

a primary fluid container for positioning flammable fluid therein;

a secondary container having a bottom and a plurality of walls connected to and extending upwardly from the bottom so as to define an inner chamber, said plurality of walls including front and rear walls and side walls connected to and extending between the front and rear walls, said secondary container having at least portions of said primary fluid container positioned within the inner chamber;

aggregate material positioned within the inner chamber and surrounding said primary container;

a plurality of insulated mounting support brackets connected to lower end portions of said primary container for positioning in lower end portions of said inner chamber of said secondary container to thereby support said primary container when mounted in said inner chamber and insulate said primary container from said secondary container;

a plurality of insulated support straps connected to upper end portions of said primary container and connected to the plurality of side walls of said secondary container for supporting said primary container so as to insulate said primary container from said secondary container;

a weather shielding cover overlying and connected to upper end portions of said primary container and said secondary container for enclosing said primary container and for shielding said primary container from exposure to various environmental conditions; and an inner confinement cover overlying said primary container, underlying said weather shielding cover, and connected to said secondary container for confining said aggregate material to said secondary container.

19. An apparatus as defined in claim 18, wherein said weather shielding cover is mounted to said secondary container so that air can readily flow through respective front and rear openings of the apparatus to thereby provide additional cooling to said primary container, the front and rear openings being respectively defined by upper end peripheries of the front and rear walls of said secondary container and lower end peripheries of said weather shielding cover.

20. An apparatus as defined in claim 19, wherein upper end portions of said primary container extend upwardly at a higher elevation than upper end portions of the side walls of said secondary container, and wherein said weather shielding cover detachably connects to and has portions thereof extending upwardly at a predetermined angle from the upper end portions of the side walls of said secondary container toward the upper end portions of said primary container and overlies the upper end portions of said primary container so that moisture readily flows downwardly from said weather shielding cover.

21. An apparatus as defined in claim 20, wherein said aggregate material comprises sand material.

22. An apparatus as defined 21, wherein said weather shielding cover includes a top panel overlying upper end portions of said primary container and extending generally parallel to the bottom of said secondary container and front and rear cover panels connected to and extending downwardly from said top panel so that lower end peripheries of the front and rear cover panels extend downwardly beyond and spaced-apart from upper end peripheries of the respective front and rear walls of said secondary container.

23. An apparatus as defined in claim 22, wherein said weather shielding cover further includes a plurality of side panels, the plurality of sides panels include a first pair of side panels connected to and extending divergingly downward from said top panel at a predetermined angle and a second pair of side panels each connected to a respective one of said first pair of side panels and extending downwardly generally parallel to the plurality of side walls of said secondary container.

24. An apparatus as defined in claim 23, further comprising a fluid distribution nozzle containment housing connected to an outer surface of said secondary container and a fluid distribution nozzle positioned in said fluid distribution nozzle containment housing and in fluid communication with said primary fluid container, said fluid distribution nozzle containment housing including a fluid distribution nozzle drip container positioned therein and positioned to receive said fluid distribution nozzle for collecting excess fluid dripping from said fluid distribution nozzle.

25. An apparatus as defined in claim 24, wherein said fluid distribution nozzle drip container comprises a plurality of walls connected along a common line thereof and connected to the inner surface of the containment housing so as to define an inner drip container chamber, at least one of the walls of said drip container having a side opening extending therethrough to the inner drip container chamber for positioning a distal end of said fluid distribution nozzle through the side opening, lower portions of said drip container having an inclined surface and a lower end opening positioned at lower ends of the inclined surface so that excess fluid dripping from a distal end of said fluid distribution nozzle readily flows to and through the lower end opening.

26. An above-ground flammable fluid containment apparatus comprising:

a primary fluid container for positioning flammable fluid therein;

a secondary container having a bottom and a plurality of walls connected to and extending upwardly from the bottom so as to define an inner chamber, said plurality of walls including front and rear walls and side walls connected to and extending between the front and rear walls, said secondary container having at least portions of said primary fluid container positioned within the inner chamber so that outer surfaces of said primary fluid container and inner surfaces of said secondary container define an interstitial space;

a weather shielding cover overlying and connected to upper end portions of said primary container and said secondary container for enclosing said primary container and for shielding said primary container from exposure to various environmental conditions;

a fluid distribution nozzle containment housing connected to an outer surface of said secondary container, said fluid distribution nozzle containment housing including a fluid distribution nozzle drip container positioned in said fluid distribution nozzle containment housing for collecting therein; and a fluid distribution nozzle positioned in said fluid distribution nozzle containment housing, in fluid communication with said primary fluid container, and to mount to said fluid distribution nozzle drip container.

27. An apparatus as defined in claim 26, wherein said fluid distribution nozzle drip container comprises a plurality of walls connected along a common line thereof and connected to the inner surface of the containment housing so as to define an inner drip container chamber, at least one of the walls of said drip container having a side opening extending therethrough to the inner drip container chamber for positioning a distal end of said fluid distribution nozzle through the side opening, lower portions of said drip container having an inclined surface and a lower end opening positioned at lower ends of the inclined surface so that excess fluid dripping from a distal end of said fluid distribution nozzle readily flows to and through the lower end opening.

28. An apparatus as defined in claim 27, wherein said weather shielding cover is mounted to said secondary container so that air can readily flow through respective front and rear openings of the apparatus into the interstitial space surrounding said primary container to thereby cool said primary container, the front and rear openings being respectively defined by upper end peripheries of the front and rear walls of said secondary container and lower end peripheries of said weather shielding cover.

29. An above-ground flammable fluid containment apparatus comprising:

at least a primary fluid container for positioning flammable fluid therein;

a fluid distribution nozzle positioned in fluid communication with said primary fluid container for distributing fluid therethrough; and a fluid distribution nozzle containment housing associated with said primary fluid container for housing said fluid distribution nozzle, said fluid distribution nozzle containment housing including a fluid distribution nozzle drip container positioned therein and positioned to receive a fluid distribution nozzle for collecting excess fluid dripping from said fluid distribution nozzle, said fluid distribution nozzle drip container comprising at least one wall connected to the inner surface of the containment housing so as to define an inner drip container chamber, the at least one wall of said drip container having a side opening extending therethrough to the inner drip container chamber for positioning a distal end of said fluid distribution nozzle through the side opening, lower portions of said drip container having an inclined inner surface and a lower end opening positioned at lower ends of the inclined inner surface so that excess fluid dripping from a distal end of a fluid distribution nozzle readily flows to and through the lower end opening.

30. An apparatus as defined in claim 29, further comprising a secondary container having a bottom and a plurality of walls connected to and extending upwardly from the bottom so as to define an inner chamber, said plurality of walls including front and rear walls and side walls connected to and extending between the front and rear walls, said secondary container having at least portions of said primary fluid container positioned within the inner chamber.

31. An apparatus as defined in claim 30, further comprising a fluid irrigating system positioned to overlie said primary and secondary containers for providing fluid irrigation to said primary and secondary containers.

32. A method of flammable fluid containment, the method comprising:

positioning at least portions of a primary fluid container within an inner chamber of a secondary container so that outer surfaces of the primary fluid container and inner surfaces of the secondary container define an interstitial space;

positioning a weather shielding cover so as to overlie upper end portions of the primary container and the secondary container to thereby enclose the primary container and shield the primary container from exposure to various environmental conditions; and mounting the weather shielding cover to the secondary container so as to provide an air flow path through respective front and rear openings into the interstitial space surrounding the primary container to thereby cool the primary container, the front and rear openings being respectively defined by upper end peripheries of the front and rear walls of the secondary container and lower end peripheries of the weather shielding cover.

33. A method as defined in claim 32, further comprising connecting a plurality of support straps connected to upper portions of the primary container to upper portions of the secondary container for providing additional support to the primary container.

34. A method as defined in claim 33, further comprising disconnecting the plurality of support straps connected to upper portions of the primary container from the upper portions of the secondary container and lifting the combination of the primary container and the shielding cover into and out of the inner chamber of the secondary container.

35. A method as defined in claim 32, wherein the weather shielding cover includes a top panel connected to upper end portions of the primary container and front and rear cover panels connected to and extending downwardly from the top panel so that lower end peripheries of the front and rear cover panels extend downwardly beyond and spaced-apart from upper end peripheries of the respective front and rear walls of the secondary container, and wherein the method further comprises cooling the primary container by air flowing through the front and rear openings and surrounding the primary container.

36. A method as defined in claim 32, further comprising providing a fluid irrigating system connected to the weather shielding cover so as to allow fluid supplied to the fluid irrigation system to irrigate the primary and secondary containers.

37. A method as defined in claim 33, further comprising providing a fluid distribution nozzle containment housing connected to an outer surface of the secondary container, the fluid distribution nozzle containment housing including a fluid distribution nozzle drip container positioned therein and positioned to receive a fluid distribution nozzle, and the method further comprising positioning a fluid distribution nozzle positioned in fluid communication with the primary fluid container on the fluid distribution nozzle drip container and collecting excess fluid dripping from the fluid distribution nozzle positioned thereon.

* * * * *